US009855778B2

(12) United States Patent
Takeuchi et al.

(10) Patent No.: US 9,855,778 B2
(45) Date of Patent: Jan. 2, 2018

(54) APPLIED VOLTAGE SETTING METHOD, PROGRAM, AND INK JET PRINTER

(71) Applicant: SEIKO EPSON CORPORATION, Tokyo (JP)

(72) Inventors: Yasuhiro Takeuchi, Nagano (JP); Toru Takahashi, Nagano (JP); Tsuneo Kasai, Nagano (JP); Akira Akazawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/970,645

(22) Filed: Dec. 16, 2015

(65) Prior Publication Data

US 2016/0200125 A1 Jul. 14, 2016

(30) Foreign Application Priority Data

Jan. 14, 2015 (JP) ..... 2015-004642

(51) Int. Cl.

| | |
|---|---|
| ***B41J 29/393*** | (2006.01) |
| ***B41J 11/00*** | (2006.01) |
| ***B41J 2/21*** | (2006.01) |
| ***B41J 2/045*** | (2006.01) |

(52) U.S. Cl.

CPC ..... *B41J 29/393* (2013.01); *B41J 2/0459* (2013.01); *B41J 2/04558* (2013.01); *B41J 2/04581* (2013.01); *B41J 2/2142* (2013.01); *B41J 2/2146* (2013.01); *B41J 11/002* (2013.01); *B41J 2029/3935* (2013.01)

(58) Field of Classification Search

CPC ..... B41J 2/04558

See application file for complete search history.

(56) References Cited

U.S. PATENT DOCUMENTS

2003/0184632 A1* 10/2003 Suzuki ..... B41J 11/002 347/102
2004/0036856 A1* 2/2004 Wittman ..... B41J 2/195 356/73
2005/0057591 A1* 3/2005 Konno ..... B41J 2/16585 347/13
2005/0259139 A1* 11/2005 Niiya ..... B41J 11/002 347/107
2007/0188537 A1* 8/2007 Kim ..... B41J 29/393 347/19
2007/0296405 A1* 12/2007 Ganot ..... B41J 2/435 324/207.16
2008/0309698 A1* 12/2008 Nakano ..... G02F 1/133711 347/14

(Continued)

FOREIGN PATENT DOCUMENTS

JP 2006-341231 A 12/2006
JP 2007-206717 A 8/2007
JP 2013-065624 A 4/2013

*Primary Examiner* — Shelby Fidler

(74) *Attorney, Agent, or Firm* — Global IP Counselors, LLP

(57) ABSTRACT

A method for setting a voltage applied to a head in an ink jet printer including the head that discharges ink according to an applied voltage includes a step of forming a test pattern on a medium by the ink discharged from the head, a step of measuring a film thickness of the test pattern, and a step of setting a voltage to be applied to the head based on the measured film thickness.

10 Claims, 12 Drawing Sheets

(56) References Cited

U.S. PATENT DOCUMENTS

| | | | | |
|---|---|---|---|---|
| 2009/0201326 | A1* | 8/2009 | Komori | B41J 2/04541 347/9 |
| 2011/0211011 | A1* | 9/2011 | Hoshi | B41J 2/2142 347/19 |
| 2014/0199472 | A1 | 7/2014 | Kodama et al. | |
| 2015/0273520 | A1* | 10/2015 | Okamoto | B41J 2/0458 428/172 |
| 2015/0345930 | A1* | 12/2015 | Ikeda | G01B 11/0616 356/630 |

* cited by examiner

FIG. 5

146

| | WHITE | CYAN | MAGENTA | YELLOW | BLACK | TRANSPARENT |
|---|---|---|---|---|---|---|
| TARGET INK WEIGHT | W0w | W0c | W0m | W0y | W0k | W0v |
| REFERENCE VOLTAGE | V0w | V0c | V0m | V0y | V0k | V0v |
| REFERENCE FILM THICKNESS | t0w | t0c | t0m | t0y | t0k | t0v |
| FIRST TEST VOLTAGE | V1w (V0w−X) | V1c (V0c−X) | V1m (V0m−X) | V1y (V0y−X) | V1k (V0k−X) | V1v (V0v−X) |
| SECOND TEST VOLTAGE | V2w (V0w+Y) | V2c (V0c+Y) | V2m (V0m+Y) | V2y (V0y+Y) | V2k (V0k+Y) | V2v (V0v+Y) |

FIG. 12

| DOT SIZE | UV IRRADIATION LAMP | | | | | |
|---|---|---|---|---|---|---|
| | 331 | 332 | 333 | 334 | 335 | 336 |
| L | ON | OFF | OFF | OFF | ON | ON |
| S | ON | OFF | OFF | OFF | OFF | ON |

APPLIED VOLTAGE SETTING METHOD, PROGRAM, AND INK JET PRINTER

BACKGROUND

1. Technical Field

The present invention relates to an ink jet printer.

2. Related Art

A piezo type ink jet printer adjusts weight of ink discharged from a head by adjusting a level of voltage applied to the head when discharging ink.

For example, in nanoimprint lithography using an ink jet method, a technique is proposed which suppresses variation of residual film thickness of a pattern transferred to a resist for each substrate by changing a voltage applied to a head according to the lot of functional ink (for example, see JP-A-2013-65624).

In an ink jet printer including a plurality of heads, even when the same voltage is applied to each head that discharges ink of the same color, weight of discharged ink varies for each head. When the weight of discharged ink varies for each head, there is a problem that density unevenness and the like occur in a printed matter. Further, even when ink is discharged from a single head by the same applied voltage, there is a problem that the weight of discharged ink is uneven due to temporal change of piezo and the like. Therefore, a technique is desired which suppresses variation of the weight of discharged ink, which is caused by individual difference and temporal change of the heads.

SUMMARY

An advantage of some aspects of the invention is to solve at least a part of the above problems and can be realized as the aspects described below.

(1) According to an aspect of the invention, in an ink jet printer including a head, a method for setting a voltage to be applied to the head is provided. The applied voltage setting method includes a step of forming a test pattern on a medium by ink discharged from the head, a step of measuring a film thickness of the test pattern, and a step of setting a voltage to be applied to the head based on the measured film thickness.

According to the applied voltage setting method of this aspect, a voltage to be applied to the head is set based on the film thickness of the test pattern that is formed by actually printing the test pattern, so that it is possible to correct variation of the weight of discharged ink due to a manufacturing error of the head or the like. Therefore, it is possible to suppress variation of the weight of discharged ink among a plurality of heads. Further, it is also possible to correct variation of the weight of discharged ink due to temporal change of the piezo of the head.

(2) In the applied voltage setting method of the above aspect, in the step of forming the test pattern, the test pattern may be formed by performing printing a plurality of times in the same area at a predetermined film thickness. By doing so, it is possible to form the test pattern with a film thickness suitable to measurement of the film thickness. Further, the printing is performed a plurality of times in the same area at a predetermined film thickness, so that it is possible to suppress curing unevenness and solidification of the ink and to suppress unevenness of the surface of the test pattern by setting the film thickness formed by a single printing to a film thickness where the curing unevenness and the solidification of the ink do not occur. As a result, it is possible to more accurately measure the film thickness of the test pattern and to more appropriately set the applied voltage.

(3) In the applied voltage setting method of the above aspect, the ink jet printer includes a transport mechanism that transports at least either one of the head and the medium, and the inkjet printer may form the test pattern at a transport speed according to a type of the ink discharged from the head in the step of forming the test pattern. Even when the weight of the ink discharged from the head of the ink jet printer is the same, the film thickness varies depending on the transport speed. Therefore, it is possible to create a test pattern with a film thickness suitable to film thickness measurement while suppressing unevenness of the surface of the test pattern by changing the transport speed according to curing property and solidifying property of the ink.

(4) In the applied voltage setting method of the above aspect, the ink jet printer includes an ink curing unit that cures the ink discharged from the head to the medium and the inkjet printer may cure the ink at an intensity of the ink curing unit according to a type of the ink discharged from the head in the step of forming the test pattern. It is possible to suppress unevenness of the surface of the test pattern by curing the ink at an intensity suitable to the type of the ink (the curing property, the solidifying property, and the like).

(5) In the applied voltage setting method of the above aspect, the ink jet printer includes at least a first head unit including a plurality of the heads that discharge a first color ink and a second head unit including a plurality of the heads that discharge a second color ink, and the target ink weight may be determined for each head unit. By doing so, it is possible to suppress variation of the weight of discharged ink among a plurality of heads for each color. As a result, it is possible to suppress density unevenness of a printed image and to improve image quality of the printed image.

(6) In the applied voltage setting method of the above aspect, in the step of measuring the film thickness, the film thickness may be measured from a surface opposite to a surface of the medium on which the test pattern is formed. By doing so, it is possible to suppress measurement error because even when there is unevenness on the surface of the test pattern, the film thickness measurement is difficult to be affected by the unevenness.

(7) According to another aspect of the invention, a program causing an ink jet printer to implement the applied voltage setting method of the above aspect is provided.

(8) According to another aspect of the invention, an ink jet printer is provided. The ink jet printer is an ink jet printer and includes a head that discharges ink, a storage unit that stores test pattern data representing a test pattern and a reference film thickness that is a film thickness of the test pattern corresponding to a target ink weight of ink discharged from the head, a test pattern forming unit that controls the head and causes the head to form the test pattern on a medium based on the test pattern data, a film thickness measuring unit that measures a film thickness of the test pattern, a voltage-film thickness table generation unit that creates a voltage-film thickness table representing a relationship between a voltage and a film thickness based on a voltage applied to the head when the test pattern is formed and a film thickness of the test pattern measured by the film thickness measuring unit, and an applied voltage setting unit that sets a voltage to be applied to the head based on the voltage-film thickness table and the reference film thickness. According to the ink jet printer, it is possible to automatically set the applied voltage in the ink jet printer.

Not all of a plurality of components included in each aspect of the invention described above are essential, and to solve all or part of the problems described above or to achieve all or part of the effects described in the present specification, it is possible to appropriately perform change, deletion, exchange with another new component, and partial deletion of limited content regarding part of the plurality of components. Further, to solve all or part of the problems described above or to achieve all or part of the effects described in the present specification, it is possible to combine all or part of the technical features included in one aspect of the invention described above with all or part of the technical features included in another aspect of the invention described above to form an independent aspect of the invention.

It is possible to implement the invention in various embodiments. For example, it is possible to implement the invention in a form such as a computer program for implementing the applied voltage setting method, a computer program for forming an ink jet printer, and a storage medium storing these programs. As a storage medium, it is possible to employ various media that can be read by a computer, such as, for example, a flexible disk, an HDD (Hard Disk Drive), a CD-ROM (Compact Disk Read Only Memory), a DVD (Digital Versatile Disk), a Blu-ray (registered trademark) Disc, a magneto-optical disk, a nonvolatile memory card, an internal storage device (a semiconductor memory such as a ROM and a RAM) of an image display device, and an external storage device (USB (Universal Serial Bus) memory).

BRIEF DESCRIPTION OF THE DRAWINGS

The invention will be described with reference to the accompanying drawings, wherein like numbers reference like elements.

FIG. 5 is a diagram showing a voltage setting parameter table.

FIG. 12 is an illustration for explaining a test pattern forming method of a fifth embodiment.

DESCRIPTION OF EXEMPLARY EMBODIMENTS

A. First Embodiment

A1. Configuration of Ink Jet Printer

Figure 1:
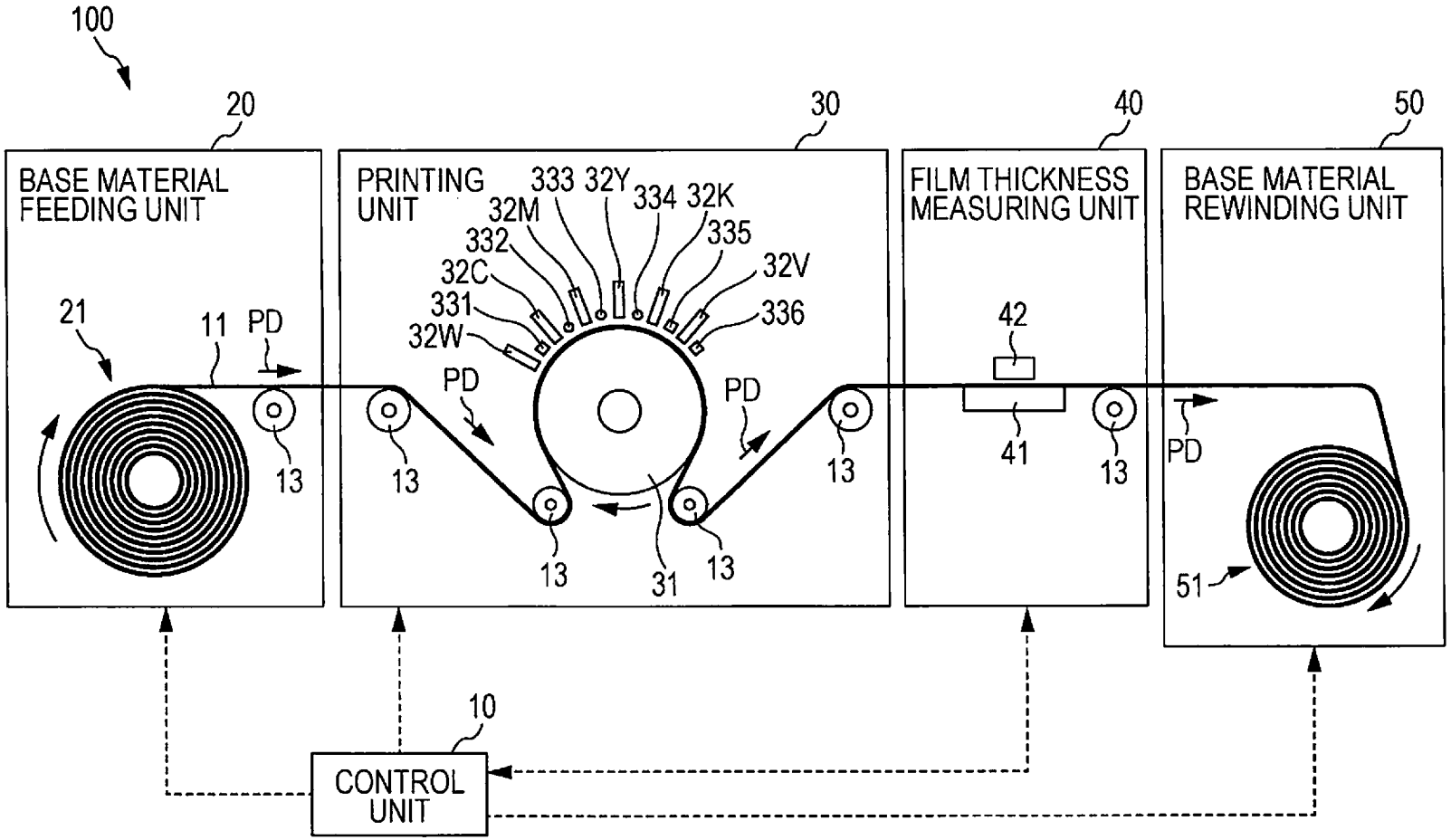
FIG. 1 is an illustration showing a schematic configuration of an ink jet printer of a first embodiment of the invention.

FIG. 1 is an illustration showing a schematic configuration of an ink jet printer 100 of a first embodiment of the invention. The ink jet printer 100 of the present embodiment is a line printer of an ink jet method which discharges ink droplets by a piezo method to form an image and performs continuous printing while transporting a printing base material 11, which is a belt-shaped recording medium, in a longitudinal direction. As the printing base material 11, for example, glossy paper, coated paper, label paper, OHP film, and the like are used. As the printing base material 11, in addition to the above, plain paper, Japanese paper, ink jet printing paper, fabric, and the like may be used.

The ink jet printer 100 mainly includes a control unit 10, a plurality of transport rollers 13, a base material feeding unit 20, a printing unit 30, a film thickness measuring unit 40, and a base material rewinding unit 50. The control unit 10 is comprised of a microcomputer including a CPU (Central Processing Unit) and a memory (a main storage unit). The control unit 10 can control each component of the ink jet printer 100. Specifically, the control unit 10 can control transport of the printing base material 11 in the ink jet printer 100, formation of a printed image in the printing unit 30, adjustment of weight of discharged ink (setting of an applied voltage), and film thickness measurement performed by the film thickness measuring unit 40.

The plurality of transport rollers 13 forms a transport path of the printing base material 11 in the ink jet printer 100. Each transport roller 13 is appropriately arranged in the base material feeding unit 20, the printing unit 30, the film thickness measuring unit 40, and the base material rewinding unit 50. Arrows PD shown in FIG. 1 indicate a transport direction of the printing base material 11 when a printed image is formed. In the present specification, "upstream" or "downstream" is based on a transport direction when a printed image is formed.

The base material feeding unit 20 includes a base material roller 21 where the printing base material 11 is wound in a roll shape. The base material roller 21 is rotated by a motor (omitted in FIG. 1) controlled by the control unit 10 and feeds the printing base material 11 to the printing unit 30.

The printing unit 30 includes a rotating drum 31, a plurality of ink head units, and a plurality of UV (ultraviolet) lamps. The ink head unit is filled with photo-curable ink (so-called UV ink) that is cured when being irradiated with UV. Ink droplets discharged from the ink heads to a printing surface of the printing base material 11 are cured by the UV lamps, so that a printed image is formed. The rotating drum 31 is rotated by a motor (omitted in FIG. 1) controlled by the control unit 10 and transports the printing base material 11 while supporting the printing base material 11 by its circumferential side surface.

The printing unit 30 includes six types of ink heads, which are a white ink head unit 32W that discharges white ink, a cyan ink head unit 32C that discharges cyan ink, a magenta ink head unit 32M that discharges magenta ink, a yellow ink head unit 32Y that discharges yellow ink, a black ink head unit 32K that discharges black ink, and a transparent ink head unit 32V that discharges transparent ink. Hereinafter, when these ink heads are not differentiated from each other, the ink heads are also referred to as simply an ink head unit 32.

Figure 2:
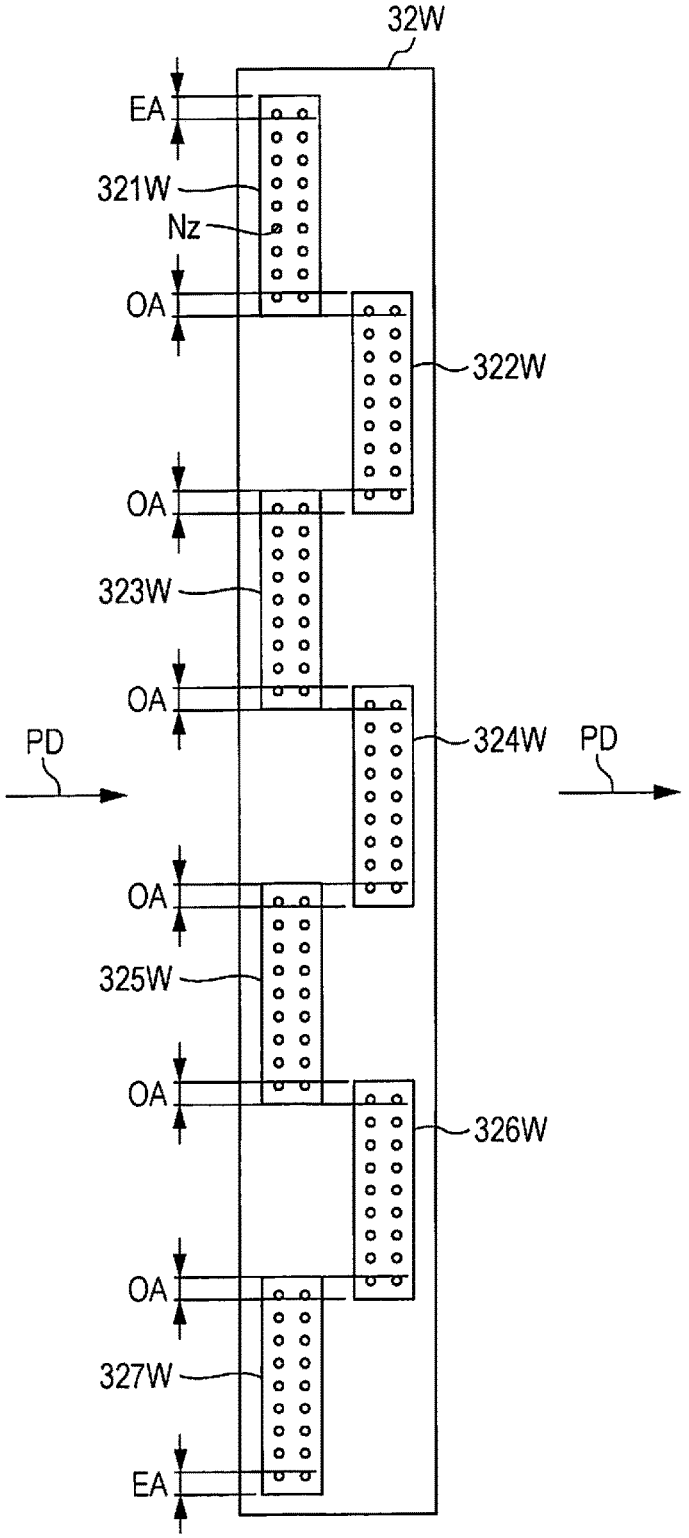
FIG. 2 is an illustration schematically showing a planar configuration of a white ink unit.

FIG. 2 is an illustration schematically showing a planar configuration of a white ink unit. FIG. 2 shows a surface facing the printing base material 11. As shown in FIG. 2, the white ink head unit 32W is a so-called line head which includes first to seventh white ink heads 321W to 327W and in which the white ink heads are arranged in two rows in a zigzag pattern (in a checkered pattern). As shown in FIG. 2, the first white ink head 321W includes a plurality of nozzles Nz. In the present embodiment, the first white ink head 321W includes 600 nozzles Nz. However, to clearly show the nozzles, in FIG. 2, the nozzles are simplified by reducing the number of nozzles and increasing the size of nozzles. Further, a symbol is given to only one nozzle Nz and the symbol is omitted for the other nozzles Nz. The second to the seventh white ink heads 322W to 327W have the same configuration as that of the first white ink head 321W. Hereinafter, when the first to the seventh white ink heads 321W to 327W are not differentiated from each other, they are also referred to as simply a white ink head 320. In the ink jet printer 100 of the present embodiment, the length of the white ink head unit 32W in a direction perpendicular to the transport direction (indicated by the arrow PD in FIG. 2) of the printing base material 11 is substantially the same as the width of the printing base material 11. The cyan ink head unit 32C, the magenta ink head unit 32M, the yellow ink head unit 32Y, the black ink head unit 32K, and the transparent ink head unit 32V have the same configuration as that of the white ink head unit 32W. Hereinafter, when these ink head units 32 are not differentiated from each other, an ink head included in the ink head unit 32 is also referred to as simply an ink head 320.

Each nozzle is provided with a piezo element which is one of electrostrictive elements and is excellent in responsiveness. The piezo element is installed at a position in contact with an ink passage that guides ink to the nozzle Nz. As everyone knows, the piezo element is an element whose crystal structure is distorted when a voltage is applied and which converts electrical energy into mechanical energy extremely quickly. In the present embodiment, an ink droplet of a predetermined weight is discharged from the tip of the nozzle Nz by deforming one side wall of the ink passage by applying a predetermined voltage between electrodes provided at both ends of the piezo element. In the ink jet printer 100 of the present embodiment, the ink head unit 32 includes a plurality of ink heads 320. In the ink jet printer 100, a target value of weight of ink discharged from one ink head 320 (hereinafter referred to as a "target ink weight") and a voltage applied to each piezo element to cause the ink head 320 to discharge an ink droplet of the target ink weight (hereinafter referred to as an "initially applied voltage") are set for each color in advance in a design stage. For example, as an initially applied voltage, the same value (V0*w*) is set for the first to the seventh white ink heads 321W to 327W included in the white ink head unit 32W. However, when the initially applied voltage V0*w* is applied to each of the first to the seventh white ink heads 321W to 327W, the weight of ink discharged from each of the first to the seventh white ink heads 321W to 327W may not be a target ink weight I0*w* due to a manufacturing error or the like. In the ink jet printer 100 of the present embodiment, it is possible to correct a voltage applied to each of the first to the seventh white ink heads 321W to 327W so that the weight of the ink discharged from each of the first to the seventh white ink heads 321W to 327W is the target ink weight I0*w*. The voltages applied to the first to the seventh white ink heads 321W to 327W after the correction are respectively referred to as a first white ink head corrected applied voltage Vhw1, a second white ink head corrected applied voltage Vhw2, a third white ink head corrected applied voltage Vhw3, a fourth white ink head corrected applied voltage Vhw4, a fifth white ink head corrected applied voltage Vhw5, a sixth white ink head corrected applied voltage Vhw6, and a seventh white ink head corrected applied voltage Vhw7. When the first to the seventh white ink heads 321W to 327W are not differentiated from each other, the voltage applied to the first to the seventh white ink heads 321W to 327W after the correction is referred to as a white ink head corrected applied voltage Vhw. The same goes for the other ink head units 32. When ink colors are not differentiated from each other, the voltage applied to the first to the seventh white ink heads 321W to 327W after the correction is referred to as a corrected applied voltage Vh. As described later in detail, an independent corrected applied voltage Vh is given to each ink head 320. The corrected applied voltage Vh in the present embodiment corresponds to a voltage (a voltage applied to a head) that is set in claims.

The printing unit 30 includes one UV lamp on the downstream side of each ink head unit 32. Specifically, a first main curing lamp 331 is arranged on the downstream side of the white ink head unit 32W, a first pinning lamp 332 is arranged on the downstream side of the cyan ink head unit 32C, a second pinning lamp 333 is arranged on the downstream side of the magenta ink head unit 32M, a third pinning lamp 334 is arranged on the downstream side of the yellow ink head unit 32Y, a second main curing lamp 335 is arranged on the downstream side of the black ink head unit 32K, and a third main curing lamp 336 is arranged on the downstream side of the transparent ink head unit 32V. The pinning lamp is a UV lamp whose radiation intensity is weaker than that of the main curing lamp, and the pinning lamp reduces landing interference by suppressing ink bleed. Hereinafter, when these lamps are not differentiated from each other, the lamps are also referred to as simply a UV lamp 33. The UV lamp 33 is controlled by the control unit 10, and ON/OFF and the radiation intensity of the UV lamp 33 are switched. The UV lamp 33 in the present embodiment corresponds to an ink curing unit in claims.

The film thickness measuring unit 40 includes a film thickness meter 41 and a base 42. In the present embodiment, the film thickness meter 41 is an electromagnetic film thickness meter and can scan in a direction substantially perpendicular to the transport direction of the printing base material 11 (arrow PD). The base 42 is a flat plate made of iron and is formed into a size where a film thickness of a test pattern described later can be measured. The film thickness meter 41 is not limited to that in the present embodiment, but various film thickness meters such as an eddy current type, an electromagnetic induction type, and an ultrasonic type can be used. The base 42 is not limited to a base made of iron, and the material of the base 42 can be appropriately selected according to a measurement principle of the film thickness meter 41.

In the present embodiment, the film thickness meter 41 is arranged on a back side of a surface (hereinafter also referred to as an ink surface) of the printing base material 11 where ink dots are formed. In the present embodiment, the film thickness measuring unit 40 measures a film thickness of a test pattern in an applied voltage setting process described later and does not measure a film thickness when the other normal printing is performed.

The base material rewinding unit 50 includes a rewinding roller 51 that is rotary driven by a motor (omitted in the drawings) controlled by the control unit 10. The rewinding roller 51 rewinds the printing base material 11 fed from the film thickness measuring unit 40. The transport roller 13 in the present embodiment corresponds to a transport mechanism in claims.

Figure 3:
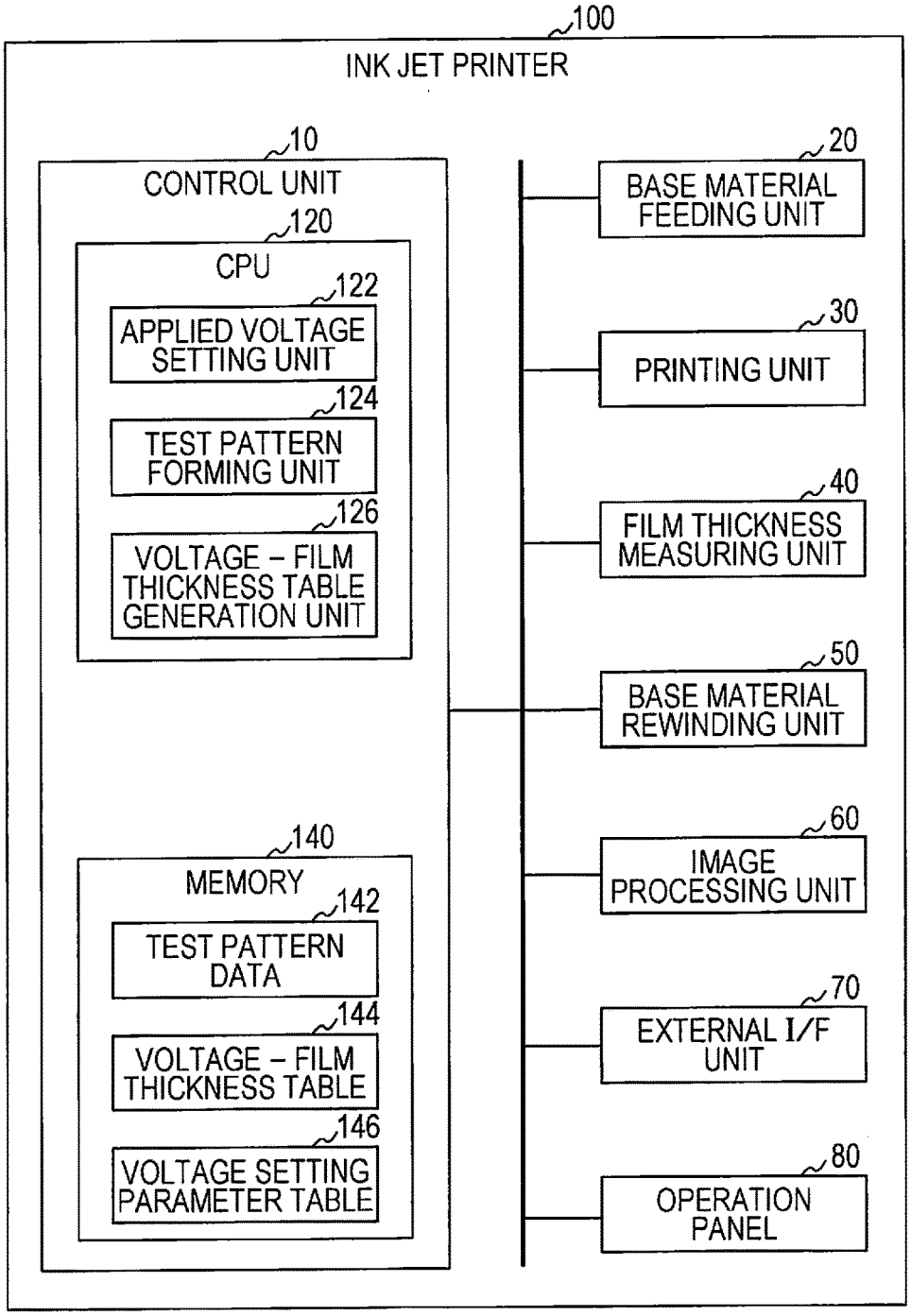
FIG. 3 is a block diagram showing a configuration of the ink jet printer.

FIG. 3 is a block diagram showing a configuration of the ink jet printer. The ink jet printer 100 includes the control unit 10, the base material feeding unit 20, the printing unit 30, the film thickness measuring unit 40, the base material rewinding unit 50, an image processing unit 60, an external I/F unit 70, and an operation panel 80. These elements are connected by a bus.

The control unit 10 includes a CPU 120 and a memory 140. The memory 140 previously stores test pattern data 142 that is image data representing a test pattern formed in the applied voltage setting process described later and a voltage setting parameter table 146 where parameters used in the applied voltage setting process are described. Further, the memory 140 stores a voltage-film thickness table 144 created in the applied voltage setting process. The CPU 120 functions as an applied voltage setting unit 122, a test pattern forming unit 124, and a voltage-film thickness table generation unit 126 according to a program stored in the memory 140.

The operation panel 80 includes a display panel including an LCD or the like for displaying a menu and an image, a cross button for operating the menu, a print instruction button (not shown in the drawings), and the like. The external I/F unit 70 is an I/F for communicating with external devices such as a digital camera, a computer, and a USB device. The image processing unit 60 is a processer which is dedicated for image processing and which is for generating print image data suitable for printing based on image data acquired through the external I/F unit 70.

A2. Applied Voltage Setting Process

Figure 4:
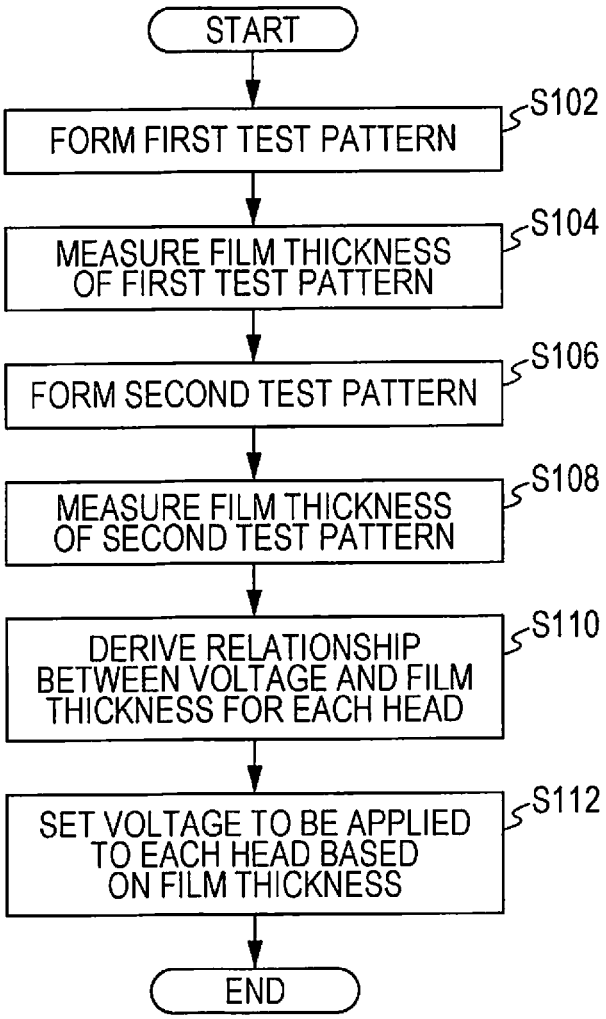
FIG. 4 is a process drawing showing an applied voltage setting process.

A setting method of a voltage to be applied to the ink head 320 will be described with reference to FIGS. 4 to 8. FIG. 4 is a process drawing showing the applied voltage setting process. FIG. 5 is a diagram showing a voltage setting parameter table. As shown in FIG. 5, the voltage setting parameter table 146 includes a target ink weight, a reference voltage, a reference film thickness, a first test voltage, and a second test voltage, which are set in advance to an ink head for each color. The target ink weight, the reference voltage, and the reference film thickness are set in advance in a design stage by printing a test pattern described later and measuring weight and film thickness by using an ink head (hereinafter also referred to as a reference ink head) having the same configuration as that of the ink head 320. For example, a white ink will be described. The target ink weight I0*w* of the white ink is determined in advance. The white ink is discharged from the reference ink head having the same configuration as that of the white ink head 320W by changing the applied voltage to a plurality of values and the weight of discharged white ink is measured for each applied voltage, and then an applied voltage when the target ink weight I0*w* is discharged is defined as a reference voltage V0*w*. Further, a test pattern described later is printed by using the reference ink head and a film thickness of the test pattern is measured, and then the film thickness is defined as a reference film thickness t0*w*. Each value of the ink head 320 for each color is as described in FIG. 5. For example, the same values (the target ink weight, the reference voltage, and the reference film thickness) are set for the first to the seventh white ink heads 321W to 327W.

When a user of the ink jet printer 100 instructs correction (setting) of the applied voltage through the operation panel 80 of the ink jet printer 100, the control unit 10 starts the applied voltage setting process. The test pattern forming unit 124 causes each ink head unit 32 to apply a first test voltage V1 for each color and to print a first test pattern based on the test pattern data 142 (step S102 in FIG. 4). In the present embodiment, the first test voltage V1 is equal to the reference voltage V0−X (X is predetermined) [V]. Specifically, as shown in FIG. 5, a first test voltage V1*w* is applied to the white ink head 320W, a first test voltage V1*c* is applied to a cyan ink head 320C, a first test voltage V1*m* is applied to a magenta ink head 320M, a first test voltage V1*y* is applied to a yellow ink head 320Y, a first test voltage V1*k* is applied to a black ink head 320K, and a first test voltage V1*v* is applied to a transparent ink head 320V.

Figure 6:
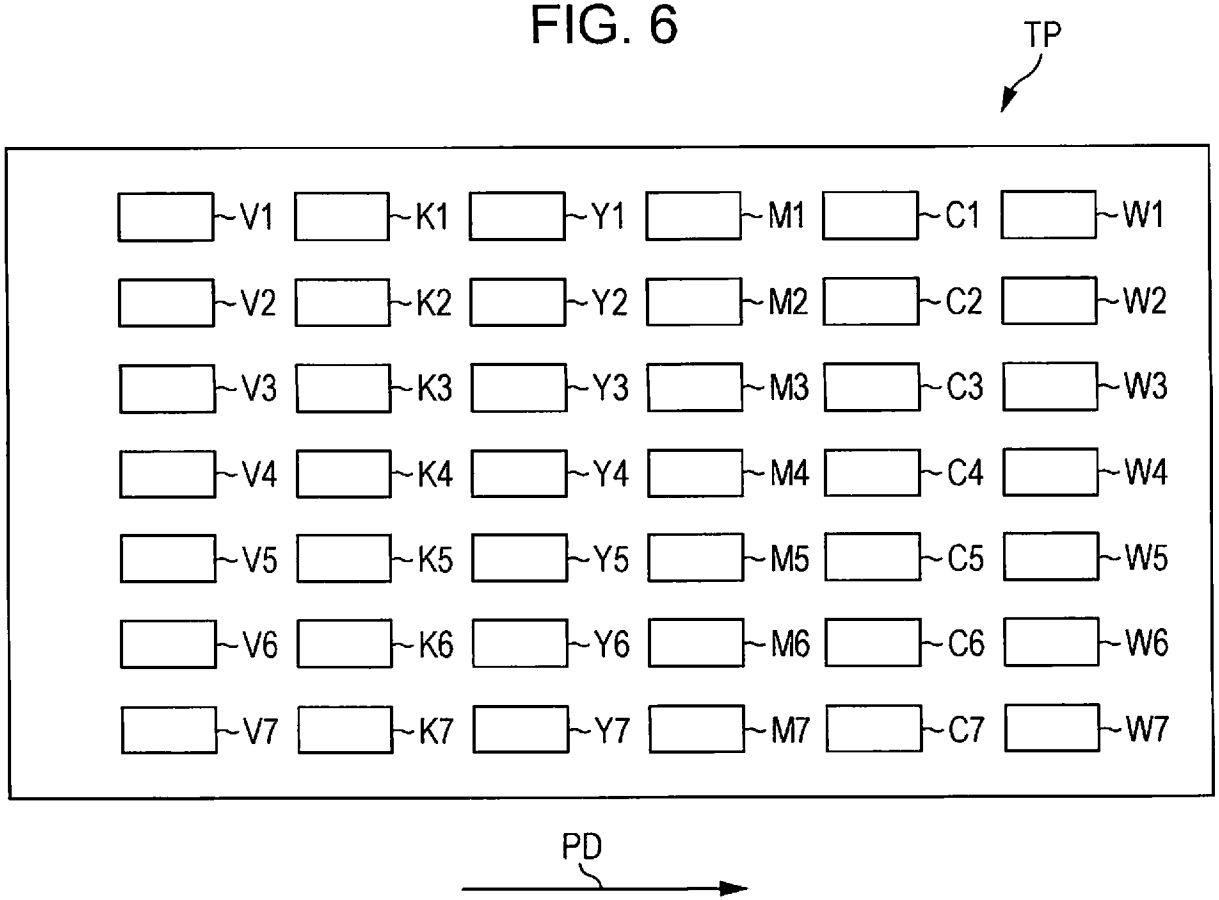
FIG. 6 is a schematic diagram schematically showing a first test pattern used in the applied voltage setting process.

FIG. 6 is a schematic diagram schematically showing the first test pattern used in the applied voltage setting process. When the printing base material 11 is transferred while the first voltages V1 shown in FIG. 5 are respectively applied to the ink heads 320, a first test pattern TP as shown in FIG. 6 is formed. The first test pattern TP includes ink areas (hereinafter also referred to as patches) where ink is discharged corresponding to each ink head 320. Specifically, the first test pattern TP includes a first white patch W1 formed by the first white ink head 321W, a second white patch W2 formed by the second white ink head 322W, . . . , and a seventh white patch W7 formed by the seventh white ink head 327W. The first to the seventh white patches W1 to W7 are formed to be separated from each other by gaps. As shown in FIG. 2, in the white ink head unit 32W, each white ink head 320W is arranged including an overlap area OA overlapping with each other in a direction substantially perpendicular to the transport direction of the printing base material 11. When the first test pattern TP is formed, it is controlled so that white ink is not discharged from the overlap area OA in each ink head 320. Thereby, a gap between patches in the first test pattern TP is formed. In the first white ink head 321W and the seventh white ink head 327W, which are arranged at the ends in a direction substantially perpendicular to the transport direction PD of the white ink head unit 32W, it is controlled so that white ink is not discharged from an area EA having the same size as that of the overlap area OA when the first test pattern TP is formed. Thereby, it is possible to equalize the areas of the first to the seventh white patches W1 to W7.

In the same manner, the first test pattern TP includes the first to the seventh cyan patches C1 to C7 formed by the first to the seventh cyan ink heads 321C to 327C, the first to the seventh magenta patches M1 to M7 formed by the first to the seventh magenta ink heads 321M to 327M, the first to the seventh yellow patches Y1 to Y7 formed by the first to the seventh yellow ink heads 321Y to 327Y, the first to the seventh black patches K1 to K7 formed by the first to the seventh black ink heads 321K to 327K, and the first to the seventh transparent patches V1 to V7 formed by the first to the seventh transparent ink heads 321V to 327V.

When the first test pattern TP is transported to the film thickness measuring unit 40, the control unit 10 causes the film thickness meter 41 to scan in a direction substantially perpendicular to the transport direction PD and measures a film thickness of each patch in the first test pattern TP (step S104 in FIG. 4). In the present embodiment, the film thickness meter 41 measures the film thickness at a plurality of positions in one patch. A film thickness measurement result obtained by the film thickness meter 41 is stored in the memory 140.

Figure 7A:
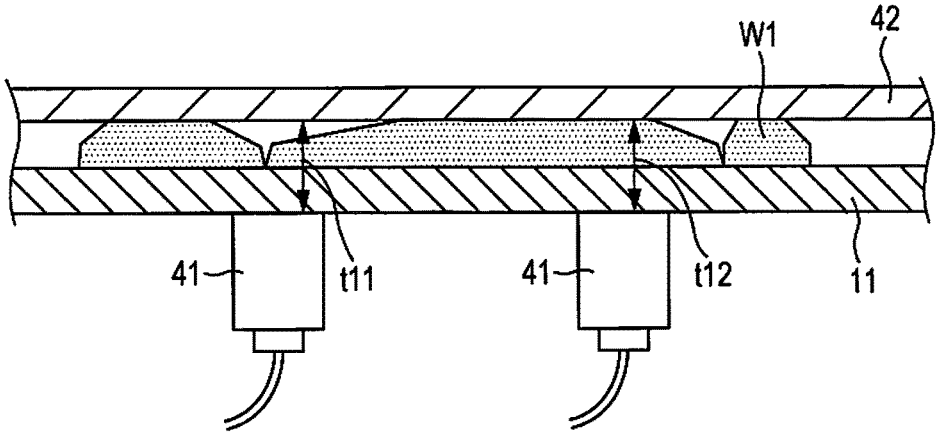
FIGS. 7A and 7B are illustrations for explaining a film thickness measurement performed in the applied voltage setting process.
Figure 7B:
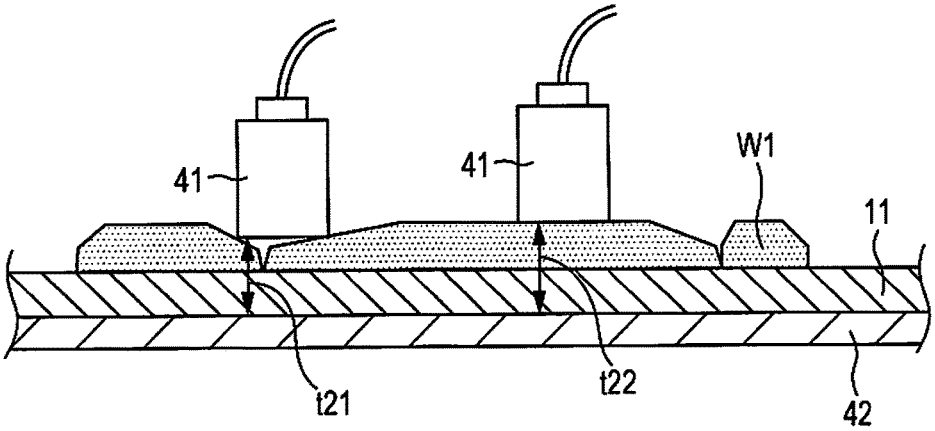
FIG. 7B (PRIOR ART)

FIGS. 7A and 7B are illustrations for explaining the film thickness measurement performed in the applied voltage setting process. FIG. 7A shows the film thickness measurement in the present embodiment. FIG. 7B shows the film thickness measurement in a comparative example. As described above, in the present embodiment, the film thickness meter 41 is arranged on the back side of the ink surface of the printing base material 11. On the other hand, in the comparative example, the film thickness meter 41 is arranged on the ink surface of the printing base material 11. As shown in FIG. 7B, in the case of comparative example, when there is unevenness on the ink surface of the printing base material 11, there is a large difference between a film thickness t21 measured by the film thickness meter 41 at a left position in FIG. 7B and a film thickness t22 measured in the right side of FIG. 7B. That is to say, the measured film thickness varies depending on the position where the film thickness meter 41 measures the film thickness, so that measurement error is large. On the other hand, in the present embodiment, the film thickness meter 41 is arranged on the back side of the ink surface of the printing base material 11. Therefore, as shown in FIG. 7A, a difference between a film thickness t11 measured by the film thickness meter 41 at a left position in FIG. 7A and a film thickness t12 measured in the right side of FIG. 7A is small. In other words, in the ink jet printer 100 of the present embodiment, the film thickness meter 41 is arranged on the back side of the ink surface of the printing base material 11, so that even when there is unevenness on the ink surface of the printing base material 11, the measured film thickness is difficult to be affected by the unevenness and it is possible to suppress the measurement error.

The film thickness meter 41 scans in a direction substantially perpendicular to the transport direction of the printing base material 11 to measure the film thickness of each of the first to the seventh white patches W1 to W7, and subsequently the film thickness meter 41 transports the printing base material 11, shifts a measurement location of the patches, and scans again to measure the film thickness of each of the first to the seventh white patches W1 to W7. The scan and measurement by the film thickness meter 41 and the transport of the printing base material 11 are repeated in this way, so that the thicknesses of all the patches of the first test pattern are measured. In the present embodiment, six points per patch are measured.

Next, the test pattern forming unit 124 causes each ink head unit 32 to apply a second test voltage V2 for each color and to print a second test pattern (step S106). As shown in FIG. 5, the second test voltage V2 is equal to the reference voltage V0+Y (Y is predetermined, X may be equal to Y or may not be equal to Y) [V]. Thereby, the same test pattern as the first test pattern TP shown in FIG. 6 is printed.

When the second test pattern is transported to the film thickness measuring unit 40, the control unit 10 causes the film thickness meter 41 to measure a film thickness of each patch in the second test pattern in the same manner as in the film thickness measurement of the first test pattern TP described above. A film thickness measurement result obtained by the film thickness meter 41 is stored in the memory 140.

Figure 8:
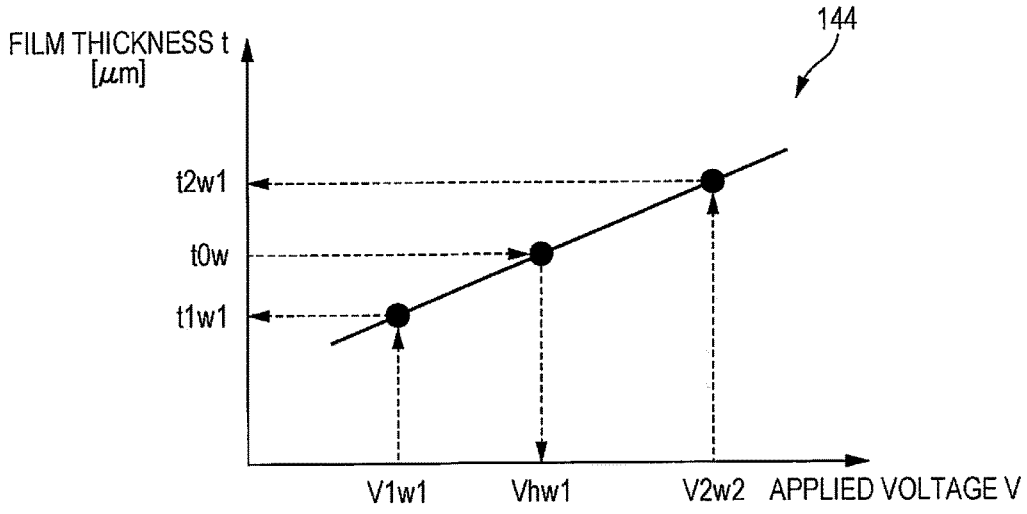
FIG. 8 is a graph showing a voltage-film thickness table of a first white ink head.

The voltage-film thickness table generation unit 126 generates the voltage-film thickness table 144 representing a relationship between the applied voltage and the film thickness based on the film thicknesses stored in steps S104 and S108 and causes the memory 140 to store the voltage-film thickness table 144 (step S110). The voltage-film thickness table 144 is stored as a relational expression between the voltage and the film thickness. Here, as the film thickness, a value is used which is obtained by subtracting a film thickness of the printing base material 11 (which is measured in advance and is stored in the memory 140) from an average value of six film thickness measurement values measured for one patch. FIG. 8 is a graph showing the voltage-film thickness table of the first white ink head. The film thickness of the first white patch when the first test voltage V1*w*1 is applied to the first white ink head 321W is t1*w*1 and the film thickness of the first white patch when the second test voltage V2*w*1 is applied to the first white ink head 321W is t2*w*1. It is well known that the film thickness linearly increases as the applied voltage increases, so that the relationship between the applied voltage and the film thickness can be linearly approximated (FIG. 8). The voltage-film thickness table 144 of each ink head is generated in the same manner as described above.

The applied voltage setting unit 122 derives and sets a voltage to be applied to each ink head based on a predetermined reference film thickness t0 and the voltage-film thickness table 144 (step S112). For example, regarding the first white ink head 321, the reference film thickness is t0*w* (FIG. 5), so that a corrected applied voltage Vhw1 corresponding to the reference film thickness t0*w* is obtained by using the voltage-film thickness table 144 shown in FIG. 8. In the same manner, the corrected applied voltages for the other ink heads are obtained. The reference film thickness t0*w* is common among the first to the seventh white ink heads 321W to 327W. In other words, the reference film thickness t0 is defined for each ink color. Hereinafter, when the ink heads are not differentiated from each other, each corrected applied voltage is referred to as a corrected applied voltage Vh. The relationship between the applied voltage and the film thickness may be different for each ink head, so that the corrected applied voltage Vh may be different for each ink head. The applied voltage setting unit 122 causes the memory 140 to store the derived corrected applied voltage Vh (sets the derived corrected applied voltage Vh in the memory 140). When the control unit 10 performs normal printing, the control unit 10 adjusts the weight of ink discharged from each head to be a target ink weight by adjusting a voltage applied to each head so that the voltage becomes the corrected applied voltage Vh for each head, which is set in the applied voltage setting process.

A3. Effects of Embodiment

In the ink jet printer 100 of the present embodiment, the applied voltage is set so that each ink head discharges a predetermined target weight of ink. Therefore, it is possible to suppress variation of the weight of discharged ink for each ink head due to a manufacturing error of the ink head or the like. As a result, it is possible to suppress density unevenness of a printed image and to improve the quality of the printed image. Further, it is also possible to suppress variation of the weight of discharged ink due to temporal change of the piezo.

In the ink jet printer 100 of the present embodiment, the voltage-film thickness table 144 representing the relationship between the applied voltage and the film thickness is generated for each ink head, and the applied voltage is set for each head based on the voltage-film thickness table 144 so that the target ink weight is achieved. The measurement of the film thickness is easier than the measurement of the ink weight, so that it is possible to easily set an appropriate applied voltage.

Hereinafter, examples where the forming methods of test pattern are different from each other will be described in second to fifth embodiments. In the second to the fifth embodiments, the components of the ink jet printer are the same as those of the first embodiment, so that the components are denoted by the same reference numerals and the description thereof is omitted.

B. Second Embodiment

Figure 9A:
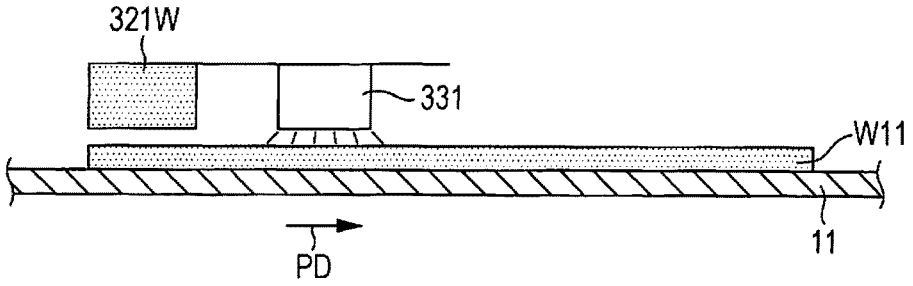
FIGS. 9A to 9D are illustrations for explaining a test pattern forming method of a second embodiment.
Figure 9B:
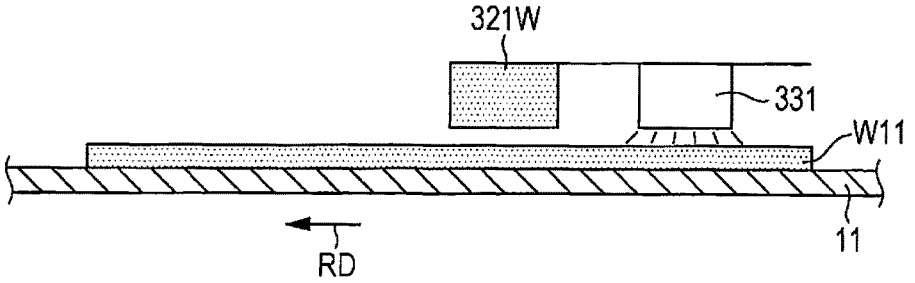
Figure 9C:
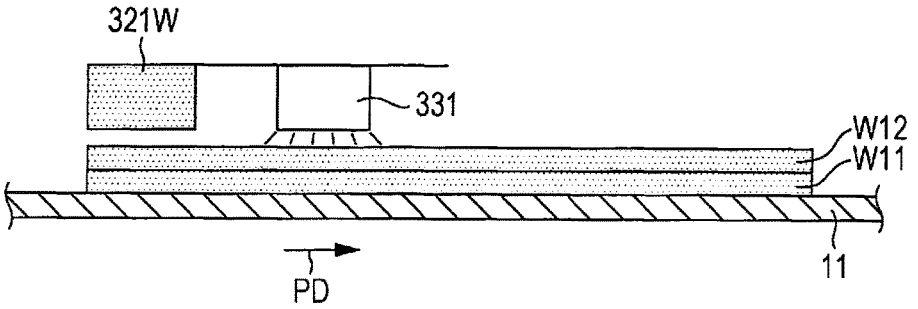
Figure 9D:
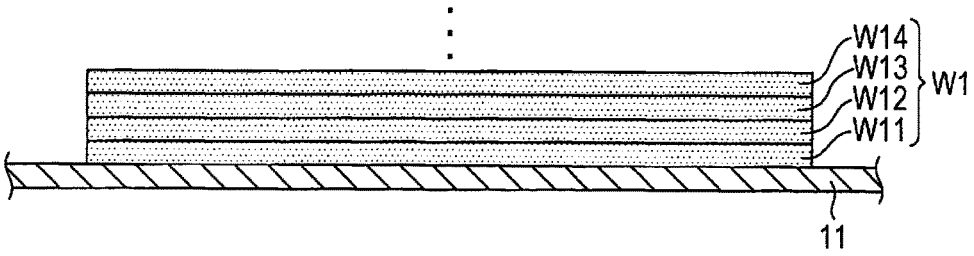

FIGS. 9A to 9D are illustrations for explaining a test pattern forming method of the second embodiment. In the second embodiment, when one patch is formed, printing (discharge of ink+UV radiation) is repeated four times. For example, the first white patch W1 that is formed with white ink discharged from the first white ink head 321W will be described with reference to FIGS. 9A to 9D. First, the first test voltage V1*w* is applied to the first white ink head 321W, the printing base material 11 is transported in the transport direction PD, and UV is radiated from the first main curing lamp 331, so that a first white patch first layer W11 is formed (FIG. 9A). Subsequently, the printing base material 11 is rewound in an arrow RD direction (FIG. 9B). The first test voltage V1*w* is applied again to the first white ink head 321W, the printing base material 11 is transported in the transport direction PD, and UV is radiated from the first main curing lamp 331, so that a first white patch second layer W12 is formed (FIG. 9C). Thereafter, the printing base material 11 is rewound, a first white patch third layer W13 is formed, the printing base material 11 is rewound, and a first white patch fourth layer W14 is formed, so that a first white patch W1 with a four-layer structure shown in FIG. 9D is formed. The second to the seventh white patches W2 to W7 are formed in the same process at the same time as the first white patch W1.

The cyan patches C, the magenta patches M, the yellow patches Y, the black patches K, and the transparent patches V are also formed in a four-layer structure.

In the present embodiment, when the test pattern is formed, one set of ink discharge and UV radiation is repeated four times, so that a four-layer structure patch is formed. When the film thickness is measured, if the film thickness of each patch is small, the measured values are within a range of measurement error, so that it is not possible to accurately measure the film thickness. On the other hand, when trying to obtain a large film thickness by one-time printing, curing unevenness occurs between surface and inside of ink, so that there is a risk that unevenness occurs in the surface. On the other hand, in the present embodiment, the film thickness formed by one-time printing is small so as not to generate curing unevenness, and printing is repeated four times in the same area (an area where a patch is formed), so that one patch is formed by stacking four layers whose film thickness is small. Therefore, the curing unevenness is suppressed and unevenness of the patch surface is suppressed, so that it is possible to accurately measure the film thickness. As a result, a voltage applied to each ink head 320 can be appropriately set.

C. Third Embodiment

Figure 10A:
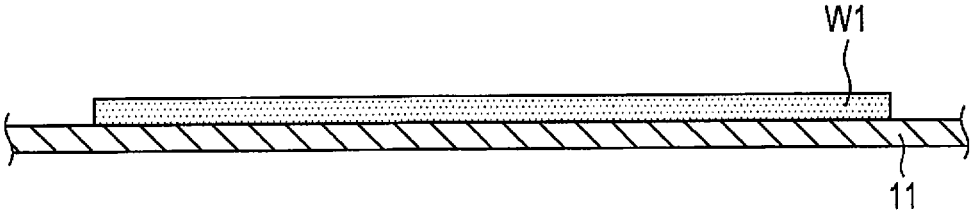
FIGS. 10A and 10E are illustrations for explaining a test pattern forming method of a third embodiment.
Figure 10B:
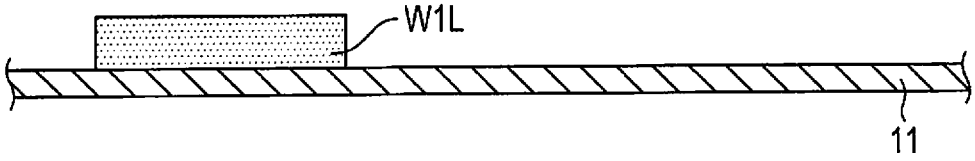

FIGS. 10A and 10B are illustrations for explaining a test pattern forming method of a third embodiment.

In the third embodiment, a test pattern is formed by transporting the printing base material 11 at a transport speed lower than that of the printing base material 11 when the test pattern is formed in the first embodiment. FIG. 10A shows the first white patch W1 formed by the test pattern forming method in the first embodiment. FIG. 10B shows a first white patch W1L formed by the test pattern forming method in the third embodiment. In the third embodiment, the first test voltage V1*w* that is the same as that in the first embodiment is applied to the first white ink head 321W for the same time period as that in the first embodiment. On the other hand, the transport speed of the printing base material 11 is lowered to about one third of that of the first embodiment. In the third embodiment, the voltage and the time applied to the first white ink head 321W are the same as those in the first embodiment, so that the weight of ink discharged from the first white ink head 321W is the same as that in the first embodiment. However, the transport speed of the printing base material 11 is slow, so that the print range (area) of the first white patch W1L of the third embodiment is smaller than that of the first white patch W1 of the first embodiment and the film thickness of the first white patch W1L of the third embodiment is greater than that of the first white patch W1 of the first embodiment.

Therefore, it is possible to measure the film thickness more accurately than in the first embodiment.

D. Fourth Embodiment

FIGS. 11A to 11D are illustrations for explaining a test pattern forming method of a fourth embodiment.

In the fourth embodiment, a test pattern is formed by changing the transport speed of the printing base material 11 for each ink color. In FIGS. 11A to 11D, the first cyan ink head 321C, the first magenta ink head 321M, the first yellow ink head 321Y, and the first black ink head 321K are illustrated, and the other ink heads and the UV lamps are not illustrated. Further, in FIGS. 11A to 11D, to clearly show correspondence relationships between each ink head 320 and each patch, the same hatching is applied to an ink head and a patch corresponding to each other. In the present embodiment, the transport speed of the printing base material 11 can be switched between a first transport speed S1, a second transport speed S2, and a third transport speed S3 (S1<S2<S3).

Figure 11A:
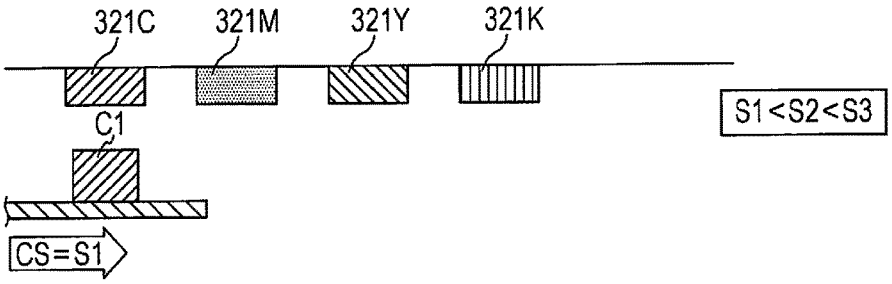
FIGS. 11A to 11D are illustrations for explaining a test pattern forming method of a fourth embodiment.
Figure 11B:
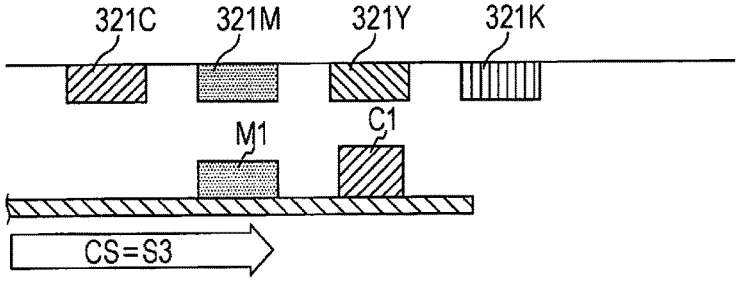
Figure 11C:
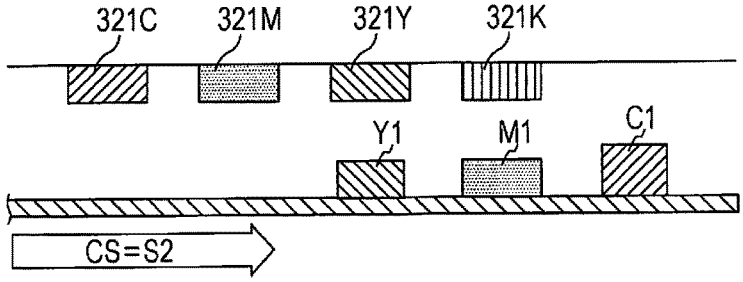
Figure 11D:
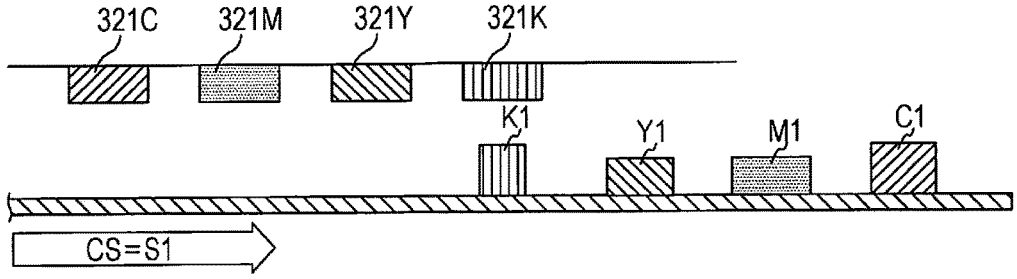

In the formation of the test pattern, the first cyan patch C1 is formed by transporting the printing base material 11 at the first transport speed S1 while applying the first test voltage V1*c* to the first cyan ink head 321C (FIG. 11A). The first magenta patch M1 is formed by transporting the printing base material 11 at the third transport speed S3 while applying the first test voltage V1*m* to the first magenta ink head 321M (FIG. 11B). The first yellow patch Y1 is formed by transporting the printing base material 11 at the second transport speed S2 while applying the first test voltage V1*y* to the first yellow ink head 321Y (FIG. 11C). The first black patch K1 is formed by transporting the printing base material 11 at the first transport speed S1 while applying the first test voltage V1*k* to the first black ink head 321K (FIG. 11D).

As described above, when the transport speed of the printing base material 11 is different, the film thickness of the patch is different. Therefore, as shown in FIG. 11D, the thicknesses of the first cyan patch C1, the first magenta patch M1, the first yellow patch Y1, and the first black patch K1 are different from each other. The curing property and solidifying property of ink vary depending on color. Therefore, the film thickness of each patch is formed to be a film thickness suitable to each color by forming the test pattern by changing the transport speed of the printing base material 11 depending on color. Therefore, it is possible to accurately measure the film thickness.

E. Fifth Embodiment

FIG. 12 is an illustration for explaining a test pattern forming method of a fifth embodiment.

In an ink jet printer of the fifth embodiment, the forming method of the test pattern varies depending on the size of a dot which is formed on the ink surface of the printing base material 11 by an ink droplet discharged from the ink head 320. The ink jet printer of the present embodiment can form a dot of L size and a dot of S size. In the present embodiment, the target ink weight of an L size dot is 20 ng and the target ink weight of an S size dot is 3 to 4 ng. However, the target ink weights are not limited to those in the present embodiment and may be set appropriately.

In the present embodiment, irradiation energy of the UV lamp is changed according to color of ink. Here, the irradiation energy is changed by ON/OFF switching of each UV lamp. Further, in the present embodiment, the irradiation energy of the UV lamp is changed according to the size of dot. As shown in FIG. 12, when the dot size is L, the first main curing lamp 331, the second main curing lamp 335, and the third main curing lamp 336 are ON and the first to the third pinning lamps 332 to 334 are OFF. Specifically, the white ink, the black ink, and the transparent ink are cured quickly by the UV irradiation after the inks are discharged, and the cyan ink, the magenta ink, and the yellow ink are cured by the second main curing lamp 335 and the third main curing lamp 336. This is because the cyan ink, the magenta ink, and the yellow ink are relatively easily cured. When the dot size is S, the first main curing lamp 331 and the third main curing lamp 336 are ON, and the first to the third pinning lamps 332 to 334 and the second main curing lamp 335 are OFF. This is because the dot size is small and the ink weight is small, so that even when the second main curing lamp 335 arranged in the downstream of the black ink head unit 32K is turned OFF, the inks can be sufficiently cured by the third main curing lamp 336.

F. Modified Examples

The invention is not limited to the embodiments described above, but can be implemented in various modes without departing from the scope of the invention. For example, the modifications described below are possible.

(1) The number of heads, the number of nozzles, the number of ink colors, and the types of ink colors are not limited to those in the embodiments described above. For example, in the embodiments described above, an ink jet printer including a plurality of line head units each of which includes a plurality of heads for one color ink is illustrated, however, a configuration may be employed in which one head may is included for one color ink. Even in such a configuration, it is also possible to correct the variation of the weight of discharged ink due to temporal change of the piezo by setting an applied voltage as described in the embodiments described above. Further, regarding the ink colors, for example, a configuration may be employed in which only the black ink is included or a configuration may be employed in which the white ink and the transparent ink are not included. Further, a configuration may be employed in which light cyan and light magenta are included.

(2) In the above embodiments, a configuration is illustrated in which the ink jet printer 100 includes the film thickness measuring unit 40. However, a configuration may be employed in which the film thickness measuring unit 40 is not included. When the film thickness measuring unit 40 is not included, for example, a configuration may be employed in which a user of the ink jet printer 100 performs the film thickness measurement as described above on each of the first test pattern and the second test pattern printed by the ink jet printer 100 and inputs each measured film thickness into the ink jet printer 100 through an operation accepting unit and then the control unit sets an applied voltage based on the inputted film thickness. Further, a configuration may be employed in which a computer for calculating and controlling voltage is included in addition to the ink jet printer 100, a user inputs film thicknesses measured by the user into the computer for calculating and controlling voltage, and applied voltages derived by the computer are set in the control unit included in the ink jet printer 100.

(3) A configuration of the film thickness measuring unit 40 is not limited to that described in the above embodiments. A configuration may be employed in which the film thickness meters 41, the number of which is the same as the number of patches of one color included in the test pattern, are included. For example, in the above embodiments, the test pattern includes seven patches for each color, so that the film thickness measuring unit 40 may include seven film thickness meters 41 so that the film thickness meters 41 correspond to the patches, respectively. By doing so, it is possible to measure the film thickness of each patch without causing the film thickness meter 41 to scan. Therefore, it is possible to reduce the time required to measure the film thicknesses. Further, a configuration may be employed in which the film thickness meters 41 are provided on the ink surface of the printing base material 11.

(4) In the above embodiments, examples are shown in which the transport speed of the printing base material 11 is changed for each ink color (the fourth embodiment) and the radiation intensity of the UV lamp is changed (the fifth embodiment). However, the method of suppressing the curing unevenness of ink and forming patches having a film thickness suitable to the film thickness measurement is not limited to the above embodiments. For example, the weight of discharged ink may be changed according to ink color. Further, it is possible to form an appropriate patch by combining differences of the transport speed, the radiation intensity of the UV lamp, and the ink discharge weight. Although the radiation intensity of the UV lamp is changed by ON/OFF of each lamp in the above embodiments, the emission intensity of each UV lamp may be changed directly. Further, the transport speed and the radiation intensity of the UV lamp may be changed according to a type of ink by classifying the type of the ink based on the curing property and the solidifying property of the ink.

(5) In the above embodiments, a configuration including a transport mechanism that transports the printing base material 11 is illustrated. However, the configuration is not limited to this. A configuration may be employed in which a transport mechanism that transports the ink head units 32 is included. Further, a configuration may be employed in which both the transport mechanism that transports the printing base material 11 and the transport mechanism that transports the ink head units 32 are included.

(6) In the above embodiments, an ink jet printer that performs printing by using UV curing ink is illustrated. However, the type of ink is not limited to that in the above embodiments. For example, a thermosetting ink, an evaporation drying type ink, and the like may be used. As an ink curing unit, it is possible to use a heater, a hot air blower, a far infrared lamp, an air blower (without heating), or the like according to the type of ink. Further, a configuration may be employed in which a platen is heated. The radiation intensity of the UV lamp and the far infrared lamp, the heating intensity of the heater and the hot air blower, the blowing intensity of the air blower, and the like correspond to an intensity of the ink curing unit in claims.

(7) In the above embodiments, an ink jet printer including the ink head 32 that discharges ink droplets by using the piezo elements is illustrated. However, the ink droplets may be discharged by another method if an ink head that discharges ink having a weight according to an applied voltage is used.

(8) In the above embodiments, an example is described in which the ink jet printer 100 internally includes the applied voltage setting unit 122, the test pattern forming unit 124, the voltage-film thickness table generation unit 126, the test pattern data 142, the voltage-film thickness table 144, and the voltage setting parameter table 146. However, at least one of them may be included in an external device and functions and data of the at least one of them may be used through the external I/F unit 70.

The invention is not limited to the embodiments and the modified examples described above, but may be realized in various configurations without departing from the scope of the invention. For example, the technical features in the embodiments and the modified examples corresponding to the technical features in the aspects described in SUMMARY can be appropriately replaced and/or combined in order to solve all or part of the problems described above or in order to achieve all or part of the effects described above. When the technical features are not described as essential in the present specification, the technical features can be properly deleted.

The entire disclosure of Japanese Patent Application No. 2015-004642, filed Jan. 14, 2015 is expressly incorporated by reference herein.

What is claimed is:

1. An applied voltage setting method for setting a voltage applied to a head in an ink jet printer including the head, the applied voltage setting method comprising:

forming a test pattern on a medium by the head;

measuring a film thickness of the test pattern by disposing a film thickness meter on a first surface of the medium that is opposite to a second surface of the medium on which the test pattern was formed; and setting a voltage to be applied to the head so that weight of UV curing ink discharged from the head is a predetermined target ink weight based on the measured film thickness, wherein when forming the test pattern, the test pattern is formed in a plurality of layers by repeating a process of printing which includes discharging the UV curing ink and irradiating the UV curing ink with UV a plurality of times on a same area of the medium.

2. The applied voltage setting method according to claim 1, wherein the ink jet printer includes a transport mechanism that transports at least either one of the head and the medium, and the inkjet printer forms the test pattern at a transport speed according to a type of the UV curing ink discharged from the head when forming the test pattern.

3. The applied voltage setting method according to claim 1, wherein the ink jet printer includes an ink curing unit that cures the UV curing ink discharged from the head to the medium, and the inkjet printer cures the UV curing ink at an intensity of the ink curing unit according to a type of the UV curing ink discharged from the head when forming the test pattern.

4. The applied voltage setting method according to claim 1, wherein the ink jet printer includes at least a first head unit including a plurality of the heads that discharge a first color ink and a second head unit including a plurality of the heads that discharge a second color ink, and the target ink weight is determined for each head unit.

5. The applied voltage setting method according to claim 1, wherein when measuring the film thickness, the film thickness is measured from a surface opposite to a surface of the medium on which the test pattern is formed.

6. A non-transitory computer readable medium storing a program for causing an ink jet printer to implement the applied voltage setting method according to claim 1.

7. A non-transitory computer readable medium storing a program for causing an ink jet printer to implement the applied voltage setting method according to claim 2.

8. A non-transitory computer readable medium storing a program for causing an ink jet printer to implement the applied voltage setting method according to claim 3.

9. A non-transitory computer readable medium storing a program for causing an ink jet printer to implement the applied voltage setting method according to claim 4.

10. A non-transitory computer readable medium storing a program for causing an ink jet printer to implement the applied voltage setting method according to claim 5.

* * * * *